United States Patent [19]

Crofton

[11] B 3,981,040

[45] Sept. 21, 1976

[54] WET MOP CONSTRUCTION HAVING PILE FABRIC MOPPING ELEMENT

[75] Inventor: John Walter Crofton, La Grange, Ga.

[73] Assignee: Deering Milliken Research Corporation, Spartanburg, S.C.

[22] Filed: Nov. 14, 1974

[21] Appl. No.: 523,885

[44] Published under the second Trial Voluntary Protest Program on February 17, 1976 as document No. B 523,885.

[52] U.S. Cl. ..... 15/229 A

[51] Int. Cl.[2] ..... A47L 13/20

[58] Field of Search ..... 15/114, 115, 116 R, 15/119 R, 120 R, 120 A, 147, 148, 150–153, 223, 224, 226, 209 R, 210 R, 228, 229, 247; 401/203, 204

[56] References Cited

UNITED STATES PATENTS

| | | | |
|---|---|---|---|
| 815,343 | 3/1906 | Garnet | 15/209 R |
| 1,804,504 | 5/1931 | Henderson | 15/247 |
| 2,011,214 | 8/1935 | Erickson | 15/209 R |
| 2,249,559 | 7/1941 | Hilty | 15/247 |
| 2,342,280 | 2/1944 | Hertzberg | 15/229 AP X |
| 3,469,274 | 9/1969 | Snapp | 15/228 |
| 3,633,234 | 1/1972 | Henningsen | 15/114 |
| 3,793,668 | 2/1974 | Olson | 15/210 R |
| 3,795,934 | 3/1974 | Moss | 15/229 A |

OTHER PUBLICATIONS

Flyer of the O'Cedar Mop Corp. entitled "Every--Which Way Mops" (Form W–1,4–55) 2246 W. 49 St. Chicago, Ill.

*Primary Examiner*—Daniel Blum

*Attorney, Agent, or Firm*—H. William Petry; L. J. Wilburn, Jr.

[57] ABSTRACT

A wet mop head construction comprising a pile fabric having a central headband for attachment to the gripping elements of a wet mop tool and a flared main body portion extending freely therefrom for contact with a surface, such as a floor, to be cleaned.

5 Claims, 4 Drawing Figures

WET MOP CONSTRUCTION HAVING PILE FABRIC MOPPING ELEMENT

This invention relates to a wet mop head construction, and, more particularly, to a pile fabric wet mop head of the type to be attached by an end-positioned headband to a mop tool or handle, with the mop head hanging freely therefrom in a flaring configuration for use in the application of liquids in the cleaning of floors and the like.

Mops of various constructions have been used for many years for "wet mopping" of floors and for applying floor waxes, synthetic floor finishes, and the like thereto. A simple type of mop is one where individual yarn strands are gathered together at one end of the yarn composite and permanently attached to a handle, usually made of wood. The disadvantage of such mops is the inability to detach the mop from the handle for laundering after the mops become soiled and/or contaminated with waxes or other floor finishes.

Later mop heads were developed having strands of yarn laid out in parallel rows, with a headband that served as a point of attachment to a handle. After attachment to the handle by suitable gripping means engaging the headband, the mop could be used for usual floor maintenance and subsequently be detached for laundering. As an additional feature in such constructions, fabric bands or thread stitches were sewn near the extremities of the mop strands to keep them in bunched configuration and from tangling during use and laundering. Such mop head constructions have certain disadvantages. Generally the ends of the mops were cut and, as a consequence, the yarns would untwist and the mop head would become unsightly, the long strands would abrade by excessive use and ultimately weaken and break. On laundering such mops, broken ends of the construction would become entangled with other ends and, as a consequence, further use of the mop head would be compromised or made impractical depending upon the degree of entanglement of the broken strands.

Such detachable stranded mops have been further developed by providing the strands in a single plane by the use of tail bands sewn or attached near the ends of the mop constructions to allow the mop yarns to spread in use. Typical of such mop heads are those disclosed in U.S. Pat. Nos. 3,324,497, 2,825,914, and 3,011,198. Such yarn spread was claimed to give efficient mopping because of the greater surface coverage provided by the spread of the yarns. To overcome excessive fraying of the cut ends of such stranded mops, mop head constructions have also employed looped yarn ends; however such loops often catch under legs of desks, chairs, and the like causing inconvenience to the user and or damage to the mops. In addition, due to the nature of the parallel yarn strands, voids are often left between adjacent yarns resulting in spreading of the yarns and leaving areas of the floor being swabbed untouched and requiring additional passes of the mop head to dry or apply liquid to the floor.

Because such wet mop heads must contact and distribute liquids during their use, it is necessary that the strands of the mops have good liquid absorption in order to retain liquids and distribute them over the area to be cleaned. Therefore, desirably such mop head strands are composed of highly hydrophilic materials, such as cotton and the like. Although cotton strands are good liquid absorbing and retaining fibers, they tend to shrink and fray both during use and when they are cleaned, as in washing in a commercial laundry. This of course reduces the floor surface coverage of the cotton stranded mops in use since the strands shorten with shrinkage. In addition, the long cotton strands rapidly weaken and fray during use thus limiting useful life of the mop. To reduce this problem the strands of the mops have been made of blends of hydrophilic and hydrophobic fibers; however, the hydrophobic components of the strands tend to cause streaks on the floors during cleaning and reduce the effective liquid pickup of the mop during use.

It is therefore and object of the present invention to provide a unique wet mop head construction of the detachable, free-hanging type which overcomes to a great extent the problems of the wet stranded mops of the prior art. More specifically, the wet mop head construction of the present invention consists of a free-hanging pile fabric material having a flared shape to provide excellent floor coverage during use and permit easy extraction of liquids from the mop, as by wringing or compressing the mop head with conventional mopping equipment. The pile fabric material is composed of a base sheet of relatively high strength and good dimensional stability to which are applied pile yarns having high water absorption characteristics. Preferably, the base sheet is composed of hydrophobic materials, such as a woven nylon fabric, to provide a strong, dimensionally stable material of quick-drying nature, while the pile yarns are preferably highly hydrophilic in nature to maintain excellent liquid absorption and retention in use of the mop. Thus, the wet mop head construction of the present invention provides excellent dimensional stability, long lasting strength, and excellent liquid absorption by the use of highly hydrophilic surface yarns.

Although it has been known in the past to provide tufted pile fabrics for use in mop constructions of the type which are supported on a wire frame or bracket to provide a generally flat, rectangular, floor contacting surface, it is not known or believed that pile fabrics have been employed in the construction of a free-hanging, wringable, flared wet mop head of the type described hereinabove.

The mop head construction of the present invention may be further described and better understood by reference to the accompanying drawings in which.

Figure 1:
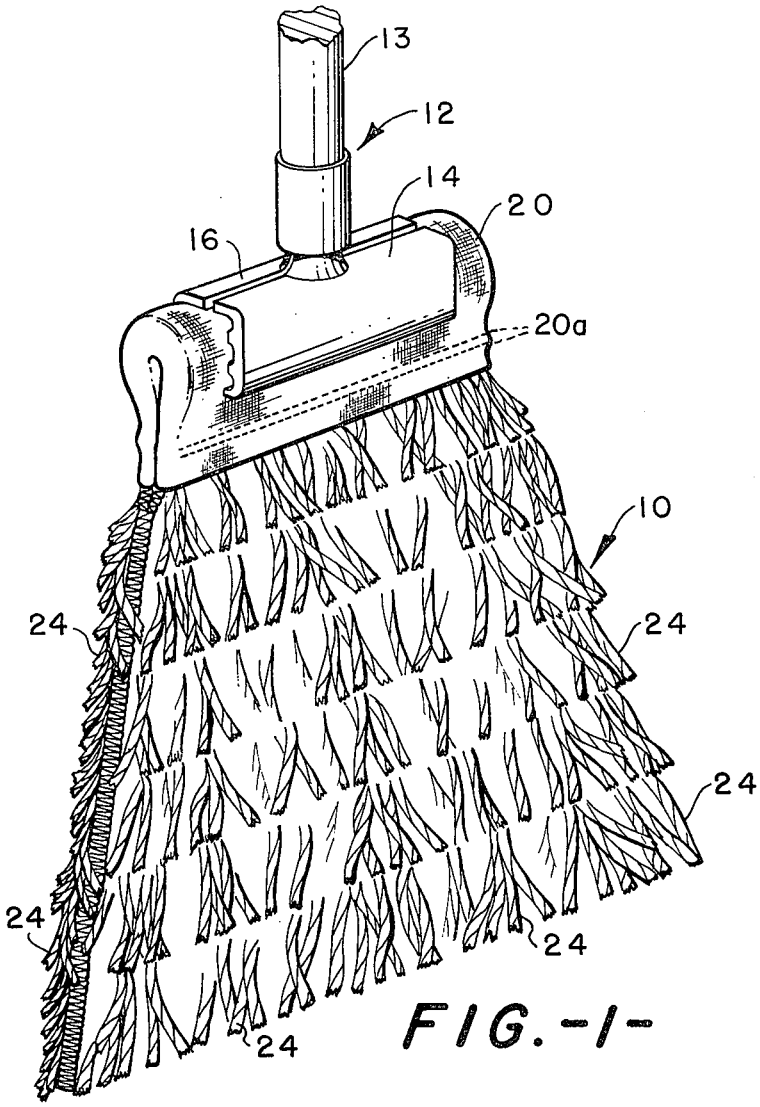
FIG. 1 is a schematic perspective view of a wet mop head construction of the present invention attached to a typical wet mop support tool.

Referring more particularly to the drawings, FIG. 1 is a perspective view of a wet mop head construction 10 of the present invention which is attached for use to a wet mop tool 12. A mop handle 13 of the tool is provided with a pair of opposed elements, or jaws, 14, 16 which are pivotally connected in conventional manner to be moved toward and away from each other and grippingly engage a headband 20 of mop head 10 during its use.

Figure 3:
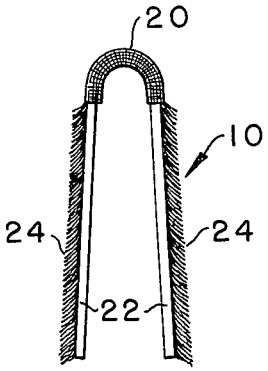
FIG. 3 is a side view of the mop head construction of the present invention showing the main body portion connected by a headband of the construction.
Figure 4:
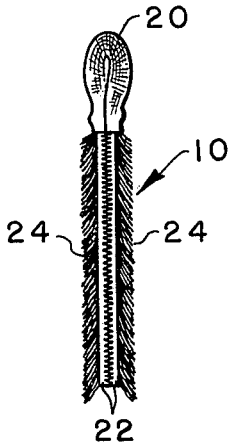
FIG. 4 is a side view of the completed mop head construction of the present invention.
Figure 2:
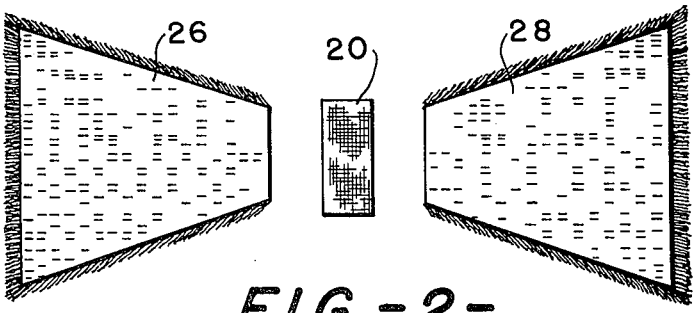
FIG. 2 is a plan view of the component parts of the mop head construction of the present invention prior to their being assembled and sewn together.

As seen in FIGS. 2 and 3, the main body of the mop head 10 is a pile fabric material comprising a base support sheet, such as a woven fabric 22, to which a plurality of pile yarns 24 are suitably attached, as by a conventional tufting operation. As further shown in FIG. 2, the main body of the mop is formed of two substantially similarly shaped trapezoidal sections 26, 28 of pile fabric which may be conveniently cut from a larger sheet of tufted pile material. The smaller sides of the two sections 26, 28 are inserted into the headband 20 of suitable material, such as a mesh knit fabric, and attached thereto as by sewing to form the unitary construction seen in FIG. 3. Lines of stitching 20*a* securing a section in the headband are shown in FIG. 1. Alternatively, the pile fabric main body could be formed of a single piece or section of pile material and the headband attached thereto at the small center area in suitable manner. The flared sections are then folded at the headband in overlying relation and their side edges sewn together to form the completed composite mop head construction shown in FIGS. 1 and 4.

As observed from the drawings in particular FIG. 1, the mop head construction is attached by its headband which overlies and is secured to the shorter parallel side of the trapezoidal shaped pile fabric to a mop tool with the fabric flaring outwardly and downwardly to its longer parallel side forming the lower end of the mop. Thus the construction is effectively spread to cover a large surface area of the surface, e.g., floor, to be cleaned.

The material employed for the backing or base sheet of the main body of the pile fabric may be of various flexible sheet construction, e.g., woven, knitted, nonwoven, cast film, etc., of sufficient strength and dimensional stability to support the pile surface yarns of the mop construction in use. Preferably, to provide relatively fast drying of the mop after use and when it is washed as well as to ensure good dimensional stability in use, the backing sheet is composed of highly hydrophobic materials, such as a woven nylon fabric. The pile yarns of the mop are preferably of a highly hydrophilic, water-absorptive nature, such as cotton and the like.

From the foregoing it can be appreciated that the flared configuration of the wet mop head provides excellent coverage of a large amount of floor area during the mopping operation, while the flexible free-hanging arrangement of the mop head permits easy wringing out or expressing of liquid from the mop. By providing a backing of high strength and hydrophobic nature the dimensional stability of the mop can be maintained, while the hydrophilic yarns employed in the pile effectively absorb and retain liquid to ensure good mopping action and distribution of liquid during use. Thus it can be seen that the mop construction is not susceptible to the excessive dimensional shrinkage as the prior art cotton stranded mops nor are the short cotton pile yarns subjected to the excessive strain and abrasion or tangles as in the long cotton strands of mops of the prior art.

The wet mop head construction of the present invention may be further illustrated by the following specific example of a method of its manufacture.

EXAMPLE

A tufted fabric is manufactured on a conventional 3/16th inch gauge tufting machine utilizing a base sheet of woven nylon fabric and tufting yarns of cotton, 2's two ply construction. The tufted fabric is thereafter cut into two identically shaped sections of trapezoidal shape, as seen in FIG. 2, and the sections sewn at their smallest ends to a knit filament nylon headband. The overlapped sections thereafter are sewn along their nonparallel sides to form the mop head construction.

The completed mop is washed in a detergent wash water at a temperature of between 160° and 180°F., and tumble dryed.

That which is claimed is:

1. A wet mop construction comprising a mop head having a flexible pile fabric main body of generally trapezoidal shape with opposite parallel sides of unequal length and opposite non-parallel sides extending in flared relation therebetween, said main body pile fabric comprising a relatively dimensionally stable base sheet having water-absorbent pile yarns attached to said sheet and being disposed to extend outwardly from opposite faces of the trapezoidal shaped main body, and a headband extending along and attached to the shorter parallel side of said pile fabric main body; and support means grippingly engaging only the headband of said mop head while leaving the pile fabric main body thereof free from supporting contact by support means to thereby position said main body in flexible, free-hanging, flaring relation from said support means.

2. A construction as defined in claim 1 wherein said main body pile fabric comprises a pair of pile fabric sections positioned in back to back, generally contiguous relation with their pile yarn faces positioned outwardly, and means securing together the corresponding side edges of each of said sections which extend from said headband.

3. A construction as defined in claim 1 wherein said base sheet is comprised of hydrophobic material, and wherein said pile yarns comprise hydrophilic materials.

4. A construction as defined in claim 3 wherein said base sheet is a woven nylon fabric and said pile yarns are cotton.

5. A construction as defined in claim 1 wherein said pile fabric is a tufted fabric.

* * * * *